US006641122B2

(12) United States Patent
Roesch

(10) Patent No.: US 6,641,122 B2
(45) Date of Patent: Nov. 4, 2003

(54) LEVER CLAMP

(75) Inventor: Hans Roesch, Gemmrigheim (DE)

(73) Assignee: Bessey & Sohn GmbH & Co., Bietigheim-Bissingen (DE)

( * ) Notice: Subject to any disclaimer, the term of this patent is extended or adjusted under 35 U.S.C. 154(b) by 0 days.

(21) Appl. No.: 10/316,999

(22) Filed: Dec. 11, 2002

(65) Prior Publication Data

US 2003/0116901 A1 Jun. 26, 2003

(30) Foreign Application Priority Data

Dec. 12, 2001 (DE) ..... 101 62 861

(51) Int. Cl.[7] ..... B25B 1/00
(52) U.S. Cl. ..... 269/6; 269/3; 269/166
(58) Field of Search ..... 269/6, 3, 166, 269/170, 167, 43

(56) References Cited

U.S. PATENT DOCUMENTS

| | | | | |
|---|---|---|---|---|
| 1,751,620 A | * | 3/1930 | Clarke | |
| 5,443,246 A | * | 8/1995 | Peterson | 269/283 |
| 5,826,310 A | * | 10/1998 | Hobday | 24/514 |
| 6,113,085 A | * | 9/2000 | Lindenthal et al. | 269/6 |

FOREIGN PATENT DOCUMENTS

| | | |
|---|---|---|
| DE | 205 157 | 12/1908 |
| DE | 21 43 312 | 3/1973 |
| DE | 31 36 879 | 3/1983 |
| DE | 87 02 645 | 5/1987 |
| DE | 100 05 634 | 11/2000 |
| FR | 979 161 | 4/1951 |

* cited by examiner

*Primary Examiner*—Lee D. Wilson
(74) *Attorney, Agent, or Firm*—Barry R. Lipsitz; Douglas M. McAllister

(57) ABSTRACT

In order to provide a lever clamp which is straightforward and cost-effective to produce and comprises a slide rail, a fixed arm, which is arranged on the slide arm, and a slide arm, which can be displaced on the slide rail and on which a lever element is mounted in a pivotable manner and a pressure plate is mounted such that it can be displaced transversely to the slide arm, it being possible for the closing movement of the pressure plate in relation to the fixed jaw to be actuated by a pivoting movement of the lever element, so that a workpiece can be clamped between the fixed jaw and pressure plate, it is provided that, in order to form a pivot bearing for the pivotability between the lever element and slide arm, a pivoting-shaft element is arranged on the lever element or the slide arm and the slide arm or the lever element has a pivoting-shaft mount, in which the pivoting-shaft element can be inserted and by means of which the pivoting-shaft element and the pivoting-shaft mount can be rotated relative to one another.

28 Claims, 4 Drawing Sheets

LEVER CLAMP

The present disclosure relates to the subject matter disclosed in German application No. 101 62 861.7 of Dec. 12, 2001, which is incorporated herein by reference in its entirety and for all purposes.

BACKGROUND OF THE INVENTION

The invention relates to a lever clamp comprising a slide rail, a fixed jaw, which is arranged on the slide rail, and a slide arm, which can be displaced on the slide rail and on which a lever element is mounted in a pivotable manner and a pressure plate is mounted such that it can be displaced transversely to the slide arm, it being possible for the movement of the pressure plate towards the fixed arm to be actuated by a pivoting movement of the lever element, so that a workpiece can be clamped between the fixed arm and pressure plate.

Such lever clamps are known by the designation GH or GSH from Bessey & Sohn GmbH & Co.

Such lever clamps can be used for clamping in workpieces by means of leverages. They can be used advantageously, in particular, when a large number of clamps have to be set in place and released in a time-saving manner. It is possible then for high clamping forces to be achieved quickly, with only a low level of force being applied, via the corresponding lever element.

SUMMARY OF THE INVENTION

In accordance with the present invention, a lever clamp which is straightforward and cost-effective to manufacture is provided.

In accordance with the invention, in order to form a pivot bearing for the pivotability between the lever element and slide arm, a pivoting-shaft element is arranged on the lever element, or the slide arm and the slide arm or the lever element has a pivoting-shaft mount, in which the pivoting-shaft element can be positioned and by means of which the pivoting-shaft element and pivoting-shaft mount can be rotated relative to one another.

Since a pivoting-shaft element is arranged on the lever element or the slide jaw and a pivoting-shaft mount, in which the pivoting-shaft element can be positioned, is provided on the corresponding other part, that is to say the slide arm or the lever element, respectively, it is possible to minimize the number of components for assembling a corresponding lever clamp. Furthermore, there is no need to provide, in particular, any positive-locking elements in order to form a corresponding pivot bearing. This also simplifies the assembly. In addition, the lever element may be manufactured from a plastics material, it being possible for the pivoting-shaft element to be produced integrally. This, in turn, minimizes the weight of such a lever clamp.

In particular, the pivoting-shaft element is arranged in a rotationally fixed manner on the lever element or the slide arm, so that, if the pivoting element is arranged on the lever element, the pivoting-shaft element can be rotated in the corresponding pivoting-shaft mount during pivoting of the lever or, if the pivoting-shaft element is arranged on the slide arm, the pivoting-shaft mount of the lever element can be rotated about the pivoting-shaft element on the slide arm. This realizes a pivot bearing which can easily be assembled and in the case of which the number of components required is minimized.

It may be provided, in principle, that the pivoting-shaft element is a separate component which is fixed correspondingly on the lever element or on the slide arm. It is quite particularly advantageous, however, if the pivoting-shaft element is formed integrally or in a one-piece arrangement on the lever element or on the slide arm. In this case, it is produced integrally with the lever element or the slide arm and the number of components is minimized as a result. The amount of time required for assembling a corresponding lever clamp is also minimized.

It may also be provided that the pivoting-shaft element is arranged in a force-locking manner on the lever element or the slide arm by, for example, a corresponding cylindrical pin being pushed into mounts provided for this purpose, in which case rotatability about this pin, or of this pin, is ensured.

It is quite particularly advantageous if the pivoting-shaft mount is formed as a recess on a surface of the slide arm or of the lever element, said recess being directed toward the fixed arm. Such an open recess, for example a half-open bore, is straightforward to produce and, in particular, can be produced integrally during the production of the slide arm or of the lever element. The assembly and, in particular, the joining together of the lever element and slide arm in order to form the pivot bearing may be simplified in that the pivoting-shaft element can be positioned in the corresponding pivoting-shaft mount, although there is no need to provide any specific positive-locking elements.

It is quite particularly advantageous if the lever element has a recess by means of which the lever element can be positioned on the slide arm such that it surrounds the latter at least partially. A corresponding lever clamp according to the invention can thus be manufactured straightforwardly and cost-effectively. On the one hand, the number of components required is minimized and, on the other hand, the lever clamp according to the invention can easily be assembled since, in particular, no screws or bolts or the like are required.

Furthermore, it is particularly advantageous if accommodating stubs are arranged on opposite surfaces of the lever element. By means of these accommodating stubs, in turn, it is possible to form a guide for a pivoting/translatory movement of the pressure plate. This, in turn, minimizes the number of components and the lever clamp according to the invention can be assembled straightforwardly and cost-effectively. Furthermore, it is thus possible to provide an inner surface for retaining a pivoting-shaft element in a force-locking manner.

In particular, an accommodating stub projects beyond a surface of the lever element in order for it to be possible for it to enter (plunge) into a guide of a pressure plate.

Furthermore, it is advantageous if the lever element and the slide arm are adapted to each other such that the pivoting-shaft element is blocked from moving in a translatory manner out of the pivoting-shaft mount. If the mount is formed as a recess in a surface, then the lever element is basically not blocked from moving away from the slide arm. The corresponding formation of the lever element and slide arm in coordination with one another, however, makes it possible to achieve such a blocking action, it nevertheless being possible for the slide arm to be manufactured, in particular, without any high-outlay milling.

For example, the lever element is provided with a first blocking element and the slide arm is provided with a corresponding second blocking element, the lever element being blocked from moving away from the slide arm by the first blocking element striking against the second blocking element. It may thus be provided that a pin element projects, or mutually opposite pin elements project, into a corresponding recess of the lever element and the slide arm is provided with a beaded rim, the lever element and slide arm being blocked from moving away from one another by the pin elements butting against the beaded rim.

In order to subject a workpiece to a compressive force, it is provided that a distance between an activating surface, by means of which the lever element acts on the pressure plate, and a surface of the slide arm which is located opposite the fixed arm depends on the pivoting angle of the lever element. This can be achieved by the formation of a corresponding eccentric surface. A workpiece may then be subjected to a compressive force via a torque exerted by means of the lever element.

It is provided, in particular, that the activating surface is closed, i.e. is continuous. The contact region by means of which said surface acts on the pressure plate is thus increased in size. Consequently, in turn, the force to which the pressure plate is subjected is distributed over a greater surface area; analogously, the same applies to the opposing forces to which the lever element is subjected by the pressure plate.

A clamping movement which is induced by the lever element and by which a workpiece is subjected to a compressive force can easily be achieved in that the pressure plate surrounds the lever element at least partially. It is thus possible for an accommodating stub on the lever element to be formed as a guide element for the pressure plate.

In particular, the pressure plate is then guided such that it can be displaced in a pivotable manner on the accommodating stub. The workpiece may be subjected to a compressive force via the displaceability which is induced by the lever element. Since a pivoting movement of the lever element has to be converted into a linear movement, and this takes place via an eccentric, the pivoting mounting ensures that the pressure plate, irrespective of the pivoting position of the lever element, is aligned in relation to the workpiece surface.

It is quite particularly advantageous if arranged in a pivotable manner on the lever element is a locking latch by means of which it is possible to block the pivotability of the lever element on the slide arm in one direction, and blocking can be released by pivoting the locking latch counter to the blocking direction, the locking latch being supported on the lever element via a spring element formed on it, and the spring element forcing the locking latch in the blocking direction.

The locking latch makes it possible to prevent release of a clamping position. Provided the locking latch is not released, the lever element can then only be moved in one direction, namely in the clamping direction. The spring element, which forces corresponding tooth elements of the locking latch automatically into a toothing formation of the slide arm, prevents the lever element from springing back. It is nevertheless possible for this clamping position to be easily released by pivoting the locking latch counter to the blocking direction, in order thus correspondingly to disengage the tooth elements from the toothing formation.

The locking latch with spring element is formed, in particular, in one piece, so that, in turn, the number of components is minimized and the locking latch can easily be fitted on the lever element. There is no need, in particular, for any separate spring element, for example a helical spring, in order to achieve the blocking action.

It is further advantageous in design terms if a pivoting shaft of the locking latch on the lever element is formed by stub elements. It is possible for these to be formed integrally on the locking latch and thus to be manufactured integrally.

Furthermore, it is advantageous if the lever element has a push-in guide for the stub elements of the locking latch, so that the stub elements can be latched in stub mounts of the lever element in order to form a pivot bearing. The corresponding pivot bearing is thus straightforward to produce without, for example, additional tools being required. If the stub elements have been latched into the stub mounts, then the locking pawl is retained in a secure and pivotable manner on the lever element. This latching-in operation is correspondingly facilitated by the push-in guide.

It is provided that the slide arm is provided with a toothing formation, it being possible for one or more tooth elements of the locking latch to be brought into engagement with the toothing formation in order to block the pivoting movement of the lever element. This allows a clamping position to be secured, it being possible, starting from such a clamping position, to ensure, for example, that it is only possible to increase the compressive force to which a workpiece is subjected, but the clamping position cannot be released; for release purposes, the locking latch has to be pivoted in relation to the lever element.

A slide arm can be manufactured cost-effectively by diecasting or injection molding. It is possible for a toothing formation to be integrally formed and likewise for a recess to be manufactured integrally as pivoting-shaft mount. There is then no longer any need for any subsequent milling processes.

The lever clamp according to the invention is straightforward and cost-effective to produce if the lever element is produced from a plastics material. The pressure plate can also be produced from a plastics material. Furthermore, the locking latch can be manufactured from a plastics material. It is also possible for the weight of a lever clamp to be minimized correspondingly.

It is possible to secure a clamping position of a workpiece between the fixed arm and the slide arm of the clamp in that the slide arm can be tilted in relation to the slide rail. The slide arm is thus secured against moving away from the workpiece in a translatory manner on the slide rail.

In particular, the lever clamp according to the invention consists of the slide rail, the fixed arm, the slide arm, the lever element, the pressure plate and a locking latch for blocking the pivotability of the lever element. A lever clamp can be assembled from a minimal number of components, it being possible, in turn, for the assembly to be easily carried out without, for example, special tools being required.

The following description of a preferred embodiment is used, in conjunction with the drawing, in order to explain the invention in more detail.

DETAILED DESCRIPTION OF THE INVENTION

Figure 1:
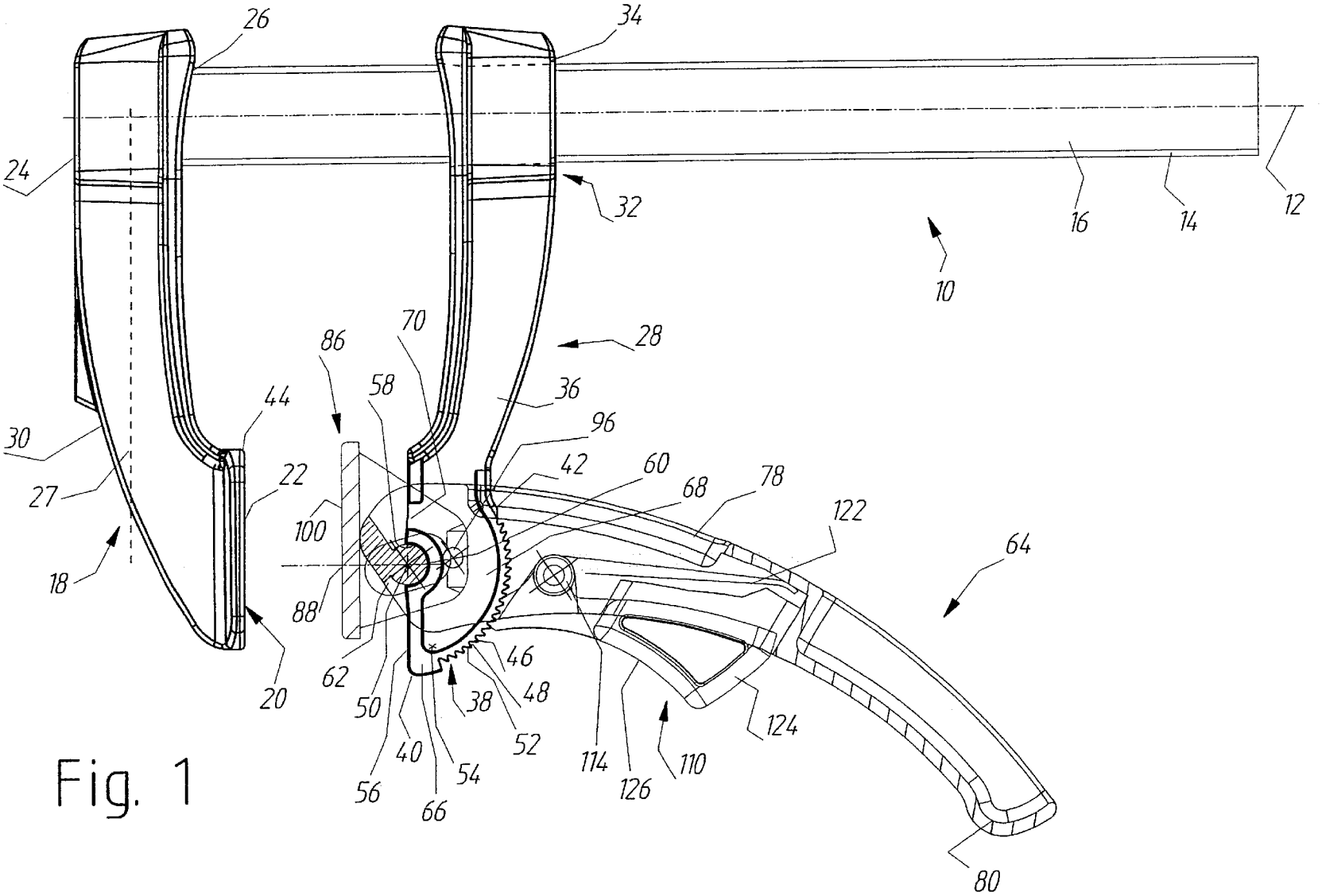
FIG. 1 shows an exemplary embodiment of a lever clamp according to the invention, a lever element with pressure plate being shown partly in section.

An exemplary embodiment of a lever clamp according to the invention, which is designated 10 as a whole in FIG. 1, comprises a slide rail 14 extending in a longitudinal direction 12. Said slide rail is, in particular, of profiled form, with a depression 16 in its longitudinal surface.

Arranged at one end of the slide rail 14 is a fixed arm 18, which is oriented transversely to the longitudinal direction 12 of the slide rail 14. This immovable, stationary fixed arm 18 has an abutment plate 20 with an abutment surface 22, which is oriented transversely, and in particular perpendicularly, to the longitudinal direction 12 of the slide rail (a normal direction of the abutment surface 22 is substantially parallel to the longitudinal direction 12 of the slide rail 14). The abutment plate 20 here is spaced apart from the slide rail 14.

A first end 24 of a mount by means of which the fixed arm 18 is arranged on the slide rail 14 is located essentially flush with the corresponding end of the slide rail 14. A second end 26 of said mount is spaced apart from the first end 24 and is arranged on the slide rail 14. The abutment plate 20, in relation to the longitudinal direction 12, is spaced apart both from the second end 26 and from the first end 24, i.e. it is offset in relation to a transverse direction 27 of the fixed arm 18. An outer side 30 of the fixed arm 18, said outer side being directed away from the slide arm 28, is curved at least in its upper region connected to the abutment plate 20, in order for it to be possible for forces to which the abutment plate 20 is subjected to be better carried off or dissipated.

The slide arm 28 is mounted in a displaceable manner on the slide rail 14. It comprises an arm root 32 with a bearing recess 34 which is adapted, in particular, to the profile of the slide rail 14 and via which the slide arm 28 is mounted on the slide rail 14. The bearing recess 34 is adapted to the slide rail 14 here such that the slide arm 28 can be tilted in relation to the slide rail and thus secured in a tilted position.

An arm part 36, which extends transversely to the longitudinal direction 12 of the slide rail 14, is formed integrally with the arm root 32. This arm part 36 comprises an arcuate toothing formation 38, which is formed on the arm part 36 on the side directed away from the fixed arm 18. The toothing formation extends, for example, into the vicinity of an upper end 40 of the slide arm 28, this upper end 40, in turn, being located some way above a corresponding end of the abutment plate 20, i.e. being spaced apart from the slide rail 14 by a somewhat greater distance than the upper end of the abutment plate 20. The toothing formation extends, in the direction of the slide rail 14, up to a point 42 which, in relation to the slide rail 14, is located some way above a corresponding lower end 44 of the abutment plate 20.

The toothing formation 38 has spaced-apart tooth elements 46, of which the one flanks 48, directed toward the arm root 32, intersect at a line 50 which is oriented transversely to the longitudinal direction. The other flanks 52 of the tooth elements intersect at a line 54 which, parallel to, and offset from, the line 50, is spaced apart from the slide rail 14 by a greater distance. The flanks 52 here are longer than the other flanks 48 of the tooth elements 46.

The arm part 36 has an essentially planar outer side 56, which is located opposite the abutment plate 20. An, in particular, semicircular recess 58 is formed in said outer side, a center point of said recess 58 being located on the line 50. The recess 58 (half-bore 58) serves as a pivoting-shaft mount for accommodating a pivoting-shaft element 60 and thus for forming a pivot bearing, which is designated 62 as a whole and by means of which a lever element 64 is mounted in a pivotable manner on the slide arm 28. The pivoting-shaft element 60 is seated in particular in a rotationally fixed manner on said lever element 64. A pivot axis of said lever element 64 substantially coincides with the line 50.

The arm part 36, in the region of the toothing formation 38, comprises a peripheral rim 66, between which a depression 68 is formed. This rim 66 forms a blocking element via which a translatory relative movement between the lever element 64 and the slide arm 28 can be blocked by means of a mating blocking element projecting correspondingly into the depression 68. The rim 66 here is interrupted via a mouth opening 70, in order for it to be possible for the mating blocking element to be introduced into the depression 68 during mounting.

In the region of the half-bore 58, the border 66 follows the contours of this recess 58.

The slide arm 28 is formed in one piece and manufactured, in particular, by means of injection molding or diecasting, the toothing formation 38 also being manufactured integrally.

Figure 2:
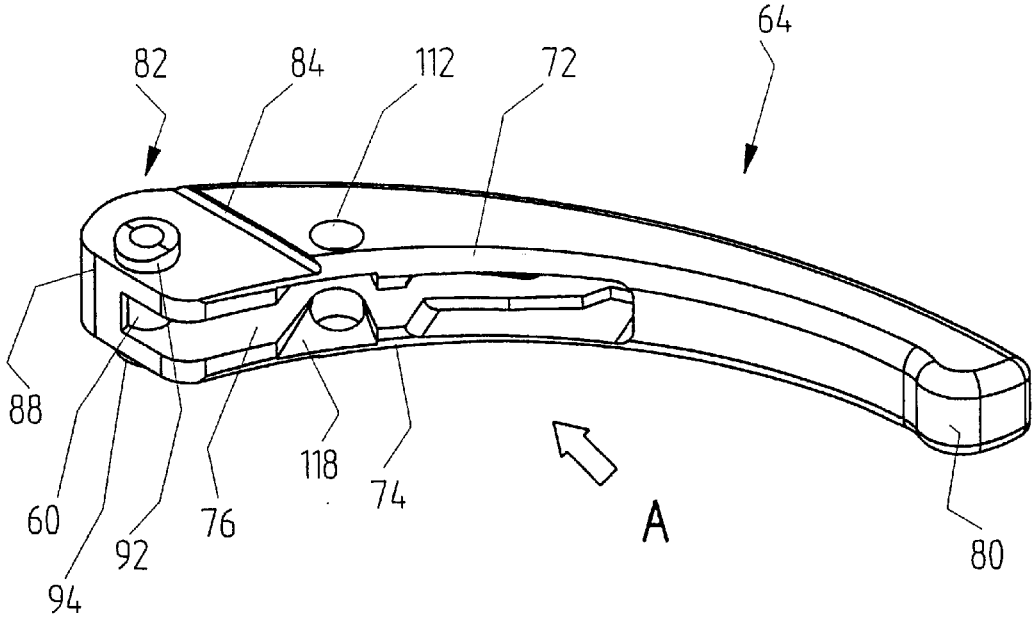
FIG. 2 shows a perspective view of the lever element of the lever clamp from FIG. 1.
Figure 3:
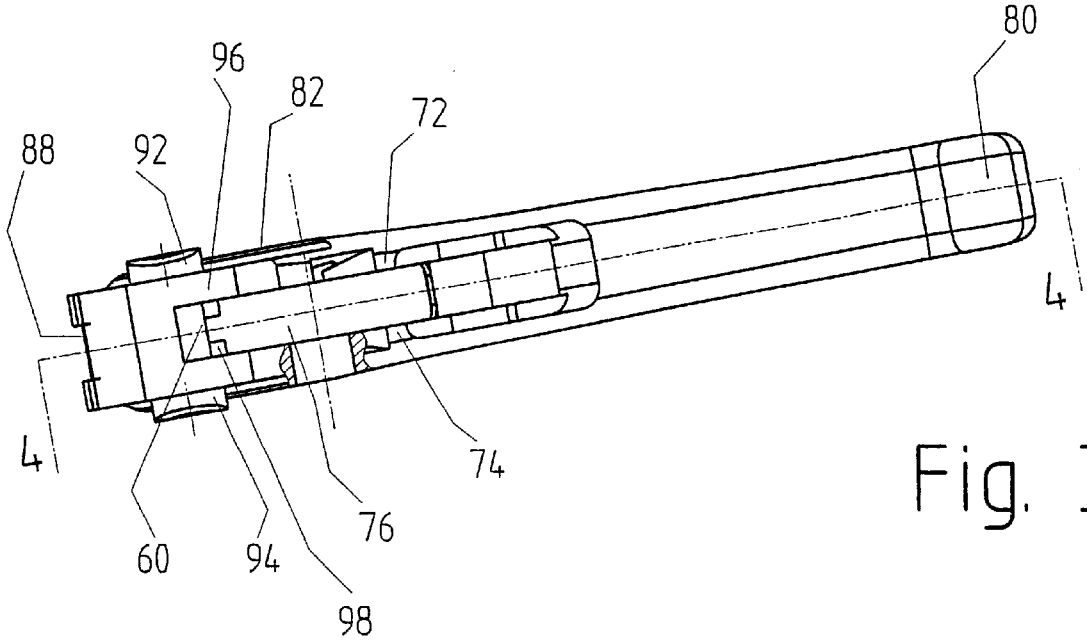
FIG. 3 shows the lever element according to FIG. 2 in a plan view in the direction A.
Figure 4:
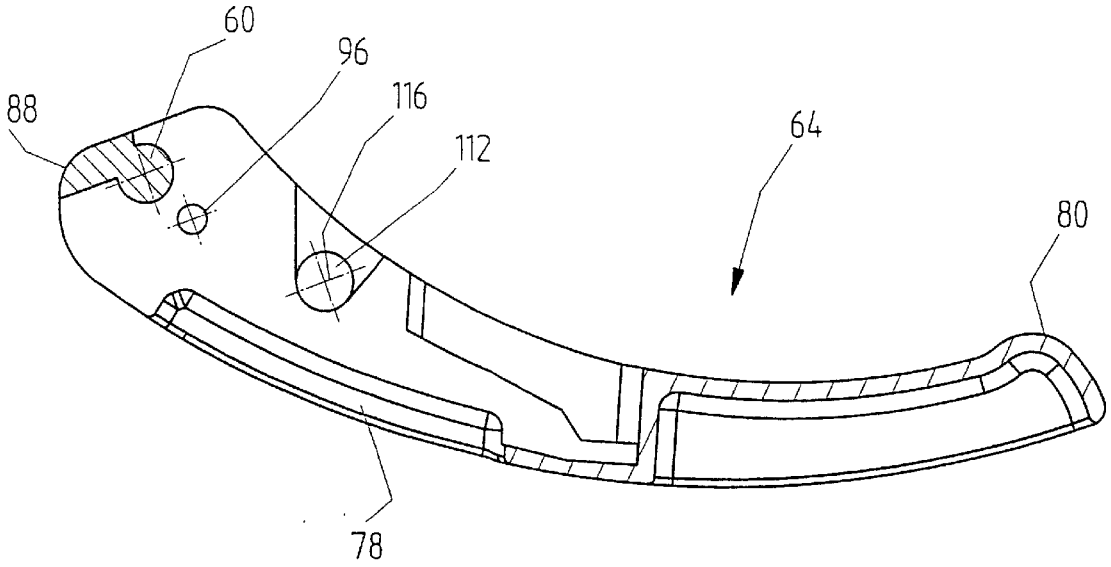
FIG. 4 shows the lever element according to FIG. 3 in a sectional view in the direction 4—4.

The lever element 64, which is mounted on the slide arm 28 such that it can be pivoted via the pivot bearing 62, extends transversely to said slide arm. It comprises a recess 76 (FIGS. 2 and 3) which is formed between mutually opposite boundary walls 72, 74 and by means of which the lever element 64 can be positioned on the slide arm 28 such that it encloses the arm part 36. The recess 76 here has a region 78 which is open in the direction of the slide rail 14, allows the lever element to be pushed onto the slide arm 28 and, despite surrounding partially or engaging around the slide arm 28, allows the pivotability of the lever element 64 relative to said slide arm at least over a certain pivoting range.

The lever element 64 is of curved form and is provided at one end with a slipping preventer 80 for a user's hand.

At the other end, in a sub-region 82, the boundary walls 72 and 74 are set back in each case on their outside, this forming a corresponding step 84 in each case, which may also be beveled. On this sub-region 82, as is described in more detail hereinbelow, a pressure plate 86 is guided such that it can be displaced in a pivotable manner relative to the lever element 64.

In its front region, which is directed away from the slipping preventer 80, the lever element 64 has an end-side activating surface 88 for the pressure plate 86, the distance between said activating surface and the planar outer side 56 of the slide arm 28 being dependent on the pivoting position of the lever element 64 on the slide arm 28. If, for example, the lever element 64, in the case of the orientation of the lever clamp 10 according to FIG. 1, has been pivoted downward, i.e. away from the slide rail 14, then the activating surface 88 is located closer to the outer side 56 than if the lever element 64 is pivoted upward in the direction of the slide rail 14. By virtue of the lever element 64 being pivoted in the pivot bearing 62 on the slide arm 28, the pressure plate 86 may be subjected to a force in order for it to be possible to move said pressure plate, in particular, in the direction of the abutment plate 20 of the fixed arm 18.

The activating surface 88 here is formed as an eccentric such that a pivoting movement of the lever element 64, in particular, in the direction of the slide rail 14 can be converted into a corresponding closing movement of the pressure plate 86 in relation to the fixed arm 18. The further the lever element 64 is pivoted in the direction of the slide rail, the closer is the activating surface 88 to a plane which runs, parallel to the longitudinal direction 12, through the line 50, the axis of rotation of the lever element 64. The activating surface 88 is thus an eccentric surface via which a pivoting movement can be converted into a translatory movement.

In particular, the activating surface 88 is a closed (continuous) surface, which thus extends over the corresponding height of the lever element 64. Consequently, the activating surface 88 is correspondingly increased in size, in order thus for it to be possible, in turn, to subject the pressure plate 86 to force in optimum fashion and to absorb the corresponding opposing forces over the largest possible region of the surface area; this minimizes pointwise force loading.

On the lever element 64, accommodating stubs 92, 94 are formed on the sub-region 82 at a distance apart in each case (in relation to the boundary walls 72 and 74 in each case). An accommodating stub 92, 94 comprises a cylindrical border which encloses, for example, a cylindrical recess in the boundary walls 72 and 74. An accommodating stub 92, 94 projects beyond the depression of the sub-region 82 and, as is also described hereinbelow, serves as a bearing for the pivoting guidance of the pressure plate 86.

The pivoting-shaft element 60 is disposed in the recess 76 between the accommodating stubs 92 and 94 and bounds said recess, in particular, laterally. The pivoting-shaft element 60 is formed integrally on the lever element 64 and has a "free" circumference, which allows the pivotability of the lever element 64 on the slide arm 28. For example, the circumferential region extends over approximately 270°, so that the pivotability of the lever element 64 over a certain pivoting range is ensured. The pivoting-shaft element 60 here has a cylindrical surface at least over the abovementioned angle range.

If the pivoting-shaft element 60, rather than being arranged in a free-standing manner in the recess 76, is integrally formed on a transverse boundary wall between the boundary walls 72 and 74, as is shown in FIGS. 1 to 4, then a corresponding lever element 64 with an integrally formed pivoting-shaft element can be produced straightforwardly and, in particular in the case of injection molding, without undercuts.

The lever element 64 can then be pushed onto the arm part 36 by means of the recess 76 and the pivoting-shaft element 60 is positioned in the half-bore 58.

The mating blocking element, in relation to the border 66 as blocking element, is formed by pins 96, 98 which each project into the recess 76 and, when the lever element 64 is pushed onto the slide arm 28, are introduced into the depression 68 via the corresponding mouth openings 70. Forming the pivoting-shaft mounts 58 for the pivoting-shaft element 60 as a half-bore ensures that the pins 96, 98 can be pushed on and the pivoting-shaft element 60 can be placed in position.

The pivoting-shaft element 60 then blocks the translatory movement of the lever element 64 in the direction of the slide arm 28 (relative to the surface 56). The abutment of the pins 96 and 98 against the respective rims 66 blocks movement in the opposite direction, away from the slide arm 28. The pins 96 and 98 here are arranged to correspond with the rim 66 and, accordingly, the border 66 is formed such that this blocking applies to every pivoting position of the lever element 64. The pivot bearing 62 is then formed as a result.

The lever element 64 is produced, in particular, from a plastics material such as polyamide.

It may also be provided that, rather than being formed integrally on the lever element 64, a pivoting-shaft element is seated in a force-locking manner thereon. For this purpose, for example, a cylinder pin is retained in the recess 76 between the boundary walls 72 and 74. The recesses of the retaining stubs 92, 94 here may serve as retaining mounts.

Figure 6:
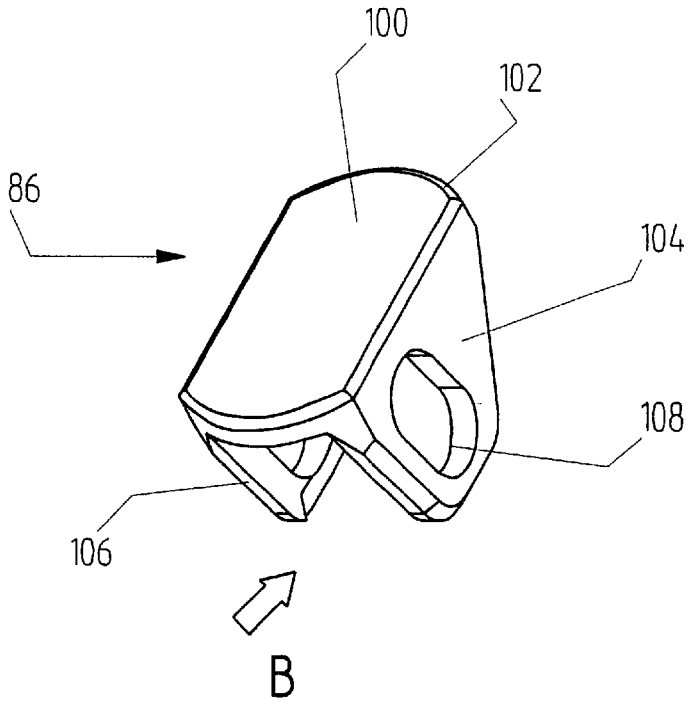
FIG. 6 shows a perspective view of a pressure plate.
Figure 7:
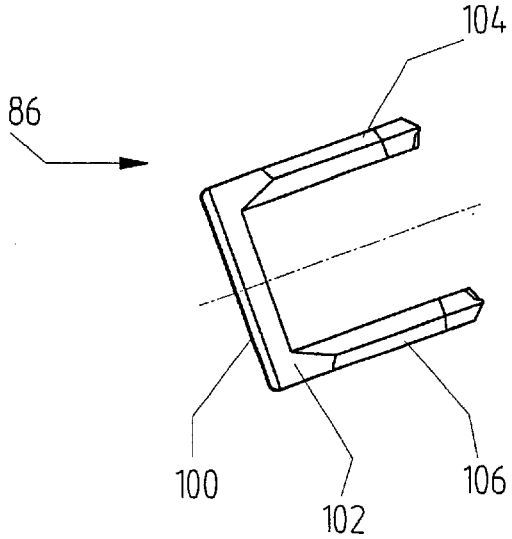
FIG. 7 shows the pressure plate according to FIG. 6 in a view in the direction B.

The pressure plate 86, which is shown in FIGS. 6 and 7, comprises an abutment surface 100 for a workpiece, which may be oriented in alignment with the abutment plate 20 of the fixed arm 18. The abutment surface 100 is formed on a cover part 102, which is seated on mutually opposite side walls 104, 106. By means of these side walls, between which there is a free space, the pressure plate 86 engages around the lever element 64 in the sub-region 82, and it is precisely in this sub-region 82 that the side walls 104, 106 are guided correspondingly, at least one boundary wall 104 or 106 abutting, at least in part, in the sub-region 82 of the lever element 64.

The side walls 104, 106 are each provided with a through-passage guide recess 108, into which the respective accommodating stubs 92, 94 enter (plunge). For this purpose, the guide recess 108 has a width which corresponds substantially to the width of an accommodating stub 92, 94 on the outside. The length and the rest of the geometric configuration of the guide recess 108 is such that the pressure plate 86 is retained on the lever element 64 such that it can be displaced in a pivotable manner, it being possible for pivoting displacement to be actuated by means of this very lever element 64.

The activating surface 88 acts here on an inner side of the cover part 102.

Figure 5:
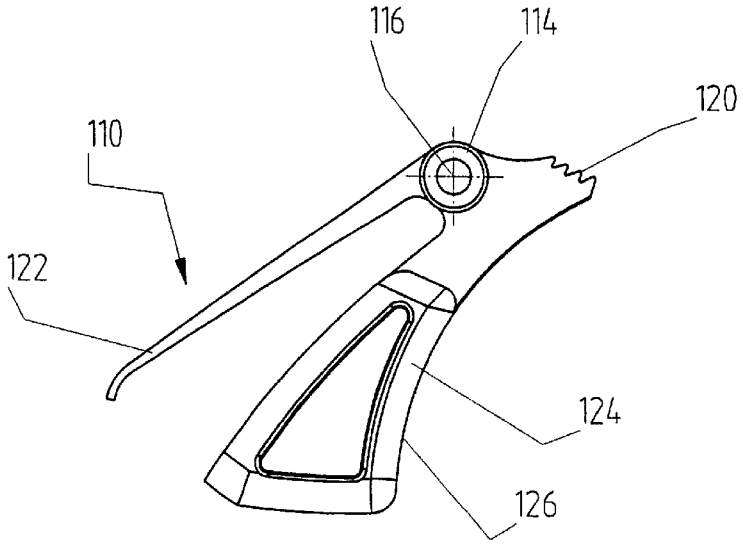
FIG. 5 shows a plan view of a locking latch.

On the lever element 64, a locking latch 110 is mounted such that it can be pivoted in the recess 76 (FIGS. 1 and 5). In order to form a pivot bearing here through-passage cylindrical recesses 112 are formed in each case in the boundary walls 72 and 74, said recesses accommodating corresponding stubs 114 which are formed on the locking latch 110. Penetration of a stub 114 into a recess 112 forms a rotary shaft with a pivot axis 116, which coincides with the axis of symmetry of the recesses 112 and of the stubs 114.

In order to facilitate the latching of the stubs 114 into the associated recesses 112, the lever element has a push-in guide 118 with a wedge surface, associated with the recesses 112 in each case, in order thus to make it easier to overcome the elastic force of the boundary walls 72, 74 of the lever element 64 when the stubs 114 are introduced into the recesses 112.

At its front end, the locking latch 110 has tooth elements 120 for engaging in the toothing formation 38 of the slide arm 28. If these tooth elements 120 are in engagement, this blocks the pivoting movement of the lever element 64 away from the slide rail 14.

Integrally formed on the locking latch 110 is a spring element 122, via which the locking latch 110 is supported on the lever element 64. The spring element 122 here is seated on a locking-paw body 124, which has an abutment surface 126 via which an operator, by exerting pressure, can pivot the locking latch 110 in the direction of the slide rail 14 relative to the lever element 64.

The spring element 122 can be tilted relative to the locking-pawl body 124 if a corresponding force is exerted. The spring element 122 and the locking-pawl body 124 here are dimensioned, and disposed in relation to one another, such that, in every pivoting position of the lever element 64, the spring element 122 pivots the locking latch relative to the lever element such that the tooth elements 120 engage with the toothing formation 38 of the slide arm 28. On account of the formation of the corresponding flanks 48, 52, and of the manner in which the lines 50 and 54 are disposed, the ability of the lever element 64 to pivot away from the slide rail 14 is then blocked irrespective of the action of the spring element 122. In order to release the engagement, the locking latch 110 has to be pivoted relative to the lever element 64 in the direction of the slide rail 14, the elastic force of the spring element 122 being overcome in the process. This makes it possible to release the blocking position by pivoting the tooth elements 120 out of the toothing formation 38.

Since the spring element 122, on account of its elastic force, forces the locking latch 110 against the toothing formation 38 by way of the tooth elements 120, unless the user subjects the locking latch 110 to a corresponding opposing force, this blocks the pivoting movement away from the slide rail 14 and the lever element 64 can only be pivoted in the direction of the slide rail 14. This automatically secures a certain pivoting position of the lever element and thus a certain clamping position in the opposite direction to the pivoting direction via the locking latch 110, and it is only by virtue of the locking latch 110 being subjected to corresponding force, i.e. pivoted relative to the lever element 64, that it is possible to eliminate the blocking of the pivoting movement of the lever element relative to the slide arms in the opposite direction to the slide rail 14, since the tooth elements 120 can then be disengaged from the toothing formation 38.

The locking latch 110 is manufactured, in particular, from a plastics material.

The lever clamp 10 according to the invention comprises and, in particular, consists of the following parts: slide rail 14, fixed arm 18, which is fixed in the slide rail, the slide arm 28, the lever element 64 with pivoting-shaft element 60, the pressure plate 86 and the locking latch 110. There is no need for any other parts.

The lever clamp 10 can be manufactured from the corresponding individual parts by the lever element 64 being pushed onto the slide arm 28, to be precise with the pins 96, 98 in the depression 68, and the pivoting-shaft element 60 being positioned in the half-bore 58. The pivot bearing 62 is then formed as a result.

The pressure plate 86 is then positioned on the accommodating stubs 92, 94, so that the accommodating stubs 92, 94 penetrate into the corresponding guide recesses 108.

The locking latch 110 is introduced in the recess 108 of the lever element 64 in order for the stubs 114 to be introduced into the recesses 112, a pivot bearing being formed corresponding. Since the spring element 122 is then supported on the lever element 64, the locking latch 110 is retained in a correspondingly prestressed manner in the lever element. (FIG. 1 shows, by dashed lines, the position which the spring element 122 would assume if it were not prestressed in relation to the locking-pawl body 124.)

It is possible for a workpiece to be clamped between the abutment plate 20 and the pressure plate 86. For this purpose, the workpiece is positioned against the abutment surface 22 and the slide arm 28 is displaced correspondingly in the direction of the workpiece and the pressure plate 86 is positioned against the workpiece by way of its abutment surface 100. Prior to the prestressing, the lever element 64 is pivoted away from the slide rail 14.

The lever element 64 is then pivoted in the direction of the slide rail 14. The activating surface 88 thus subjects the pressure plate 86 to a compressive force, as result of which the pressure plate, in turn, is displaced in the direction of the workpiece. Since the lever element 64 exerts an eccentric force, and the guide recesses 108 also ensure the rotatability of the pressure plate 86 in relation to the slide arm 28, the alignment of the pressure plate 86 relative to the workpiece is maintained.

The spring element 122 forces the tooth elements 120 of the locking latch 110 into the toothing formation 38, so that the pivoting movement of the lever element 64 is blocked in the opposite direction to the pivoting direction. This applies to each pivoting position of the lever element 64 in the direction of the slide rail 14. This makes it possible for the torque exerted via the lever element 64 to be converted into a clamping force to which the workpiece is subjected by the pressure plate 86.

In order to release the blocking of the ability of the lever element 64 to pivot away from the slide rail 14, the locking latch 110 has to be pivoted in the direction of the lever element 64, in order to release the engagement of the tooth elements 120 in the toothing formation 38. By virtue of the lever element 64 being pivoted away, the clamping force to which the workpiece is subjected is then also released correspondingly.

If the workpiece is braced between the fixed arm 18 and the slide arm 28, then the corresponding opposing force, to which the slide arm 28 is subjected by the workpiece, causes said slide arm to tilt in relation to the slide rail 14, if so permitted by the bearing recess 34. This, in turn, blocks the ability of the slide arm 28 to be displaced, on the slide rail 14, away from the workpiece.

As an alternative, it may also be provided that the pivoting-shaft element is seated in a rotationally fixed manner on the slide arm and the lever element has a corresponding recess as pivoting-shaft mount. In this case, the pivoting-shaft mount rotates about the pivoting-shaft element, while, in the case of the pivot bearing 62, the pivoting-shaft element 60 rotates in the pivoting-shaft mount 58 when the lever element 64 is pivoted.

What is claimed is:

1. A lever clamp comprising a slide rail, a fixed arm which is arranged on the slide rail;

a slide arm which is displaceable on the slide rail;

a lever element which is mounted on the slide rail in a pivotable manner;

a pressure plate which is mounted such that it is displaceable transversely to the slide arm, it being possible for the movement of the pressure plate towards the fixed arm to be actuated by a pivoting movement of the lever element, so that a workpiece is clampable between the fixed arm and pressure plate; and a pivot bearing for the pivotability between the lever element and slide arm;

said pivot bearing comprising a pivoting-shaft element acting between the lever element and the slide arm and a pivoting-shaft mount adapted for accepting the pivoting-shaft element such that the pivoting-shaft element and pivoting-shaft mount are rotatable relative to one another;

said pivoting shaft element being rotationally fixed on one of the lever element and slide arm with the pivoting shaft mount being formed on the other of the lever element and slide arm.

2. The lever clamp according to claim 1, wherein the pivoting-shaft element is formed integrally on said one of the lever element or the slide arm.

3. The lever clamp according to claim 1, wherein the pivoting-shaft element is arranged in a force-locking manner on said one of the lever element or the slide arm.

4. The lever clamp according to claim 1, wherein the pivoting-shaft mount is formed as a recess on a surface of said other one of the slide arm or of the lever element, said recess being directed toward the fixed arm.

5. The lever clamp according to claim 1, wherein the lever element has a recess by means of which the lever element is placeable on the slide arm such that the lever element surrounds the slide arm at least partially.

6. The lever clamp according to claim 1, wherein accommodating stubs are arranged on opposite surfaces of the lever element.

7. The lever clamp according to claim 6, wherein an accommodating stub projects beyond a surface of the lever element.

8. The lever clamp according to claim 6, wherein the pressure plate is guided such that it is displaceable in a pivotable manner on the accommodating stubs.

9. The lever clamp according to claim 1, wherein the lever element and the slide arm are adapted to each other such that the pivoting-shaft element is blocked from moving out of the pivoting-shaft mount.

10. The lever clamp according to claim 9, wherein the lever element is provided with a first blocking element and the slide arm is provided with a corresponding second blocking element, the lever element and slide arm being blocked from moving away relative to one another by the first blocking element striking against the second blocking element.

11. The lever clamp according to claim 1, wherein a distance between an activating surface, by means of which the lever element acts on the pressure plate, and a surface of the slide arm, said surface being located opposite the fixed arm, depends on the pivoting angle of the lever element.

12. The lever clamp according to claim 11, wherein the activating surface is closed.

13. The lever clamp according to claim 1, wherein the pressure plate surrounds the lever element at least partially.

14. The lever clamp according to claim 1, wherein a locking latch is arranged in a pivotable manner on the lever element by means of which it is possible to block the pivotability of the lever element on the slide arm in one direction, and the blocking is releasable by pivoting the locking latch counter to the blocking direction, the locking latch being supported on the lever element via a spring element formed on it, and the spring element forcing the locking latch in the blocking direction.

15. The lever clamp according to claim 14, wherein the locking latch is formed in one piece.

16. The lever clamp according to claim 14, wherein a pivoting shaft of the locking latch is formed by stub elements.

17. The lever clamp according to claim 16, wherein the lever element has a push-in guide for the stub elements of the locking latch, so that the stub elements are latchable in stub mounts of the lever element in order to form a pivot bearing.

18. The lever clamp according to claim 14, wherein the slide arm is provided with a toothing formation, it being possible for one or more tooth elements of the locking latch to be brought into engagement with the toothing formation in order to block the pivoting movement of the lever element.

19. The lever clamp according to claim 1, wherein the slide arm is manufactured by one of diecasting or injection molding.

20. The lever clamp according to claim 1, wherein the lever element is manufactured from a plastics material.

21. The lever clamp according to claim 1, wherein the pressure plate is manufactured from a plastics material.

22. The lever clamp according to claim 1, wherein the locking latch is manufactured from a plastics material.

23. The lever clamp according to claim 1, wherein the slide arm is tiltable in relation to the slide rail.

24. The lever clamp according to claim 1, consisting of the slide rail, the fixed arm, the slide arm, the lever element, the pressure plate and a locking latch for blocking the pivotability of the lever element.

25. The lever clamp according to claim 1, wherein a locking latch is arranged in a pivotable manner on the lever element by means of which it is possible to block the pivotability of the lever element on the slide arm in one direction, and the blocking is releasable by pivoting the locking latch counter to the blocking direction, the locking latch being supported on the lever element via a spring element formed on it, and the spring element forcing the locking latch in the blocking direction.

26. The lever clamp in accordance with claim 1, wherein the pivoting-shaft element is arranged on the lever element and the pivoting-shaft mount is arranged slide arm.

27. The lever clamp in accordance with claim 1, wherein the pivoting-shaft element is arranged on the slide arm and the pivoting-shaft mount is arranged on the lever element.

28. The lever clamp in accordance with claim 1, wherein the pivoting-shaft element is adapted to be inserted into the pivoting-shaft mount.

* * * * *